United States Patent [19]

Naka

[11] 3,975,870

[45] Aug. 24, 1976

[54] FLOOR HATCH

[76] Inventor: Hiromitsu Naka, No. 39, Oaza Shinmachi, Yashio, Saitama, Japan

[22] Filed: Sept. 5, 1974

[21] Appl. No.: 503,519

[52] U.S. Cl. ..... 52/20; 49/463; 404/25

[51] Int. Cl.[2] ..... E02D 29/14

[58] Field of Search ..... 52/19, 205, 20, , 200, 52/21; 49/463, 464, 465; 404/25, 26

[56] References Cited

UNITED STATES PATENTS

| | | | |
|---|---|---|---|
| 1,027,911 | 5/1912 | Schumacher | 49/463 |
| 1,600,761 | 9/1926 | Haase | 52/20 |
| 2,109,287 | 2/1938 | Elkington | 404/25 |
| 2,194,221 | 3/1940 | Elkington | 404/25 |
| 3,408,778 | 11/1968 | Mason | 52/20 |
| 3,712,009 | 1/1973 | Campagna | 52/20 |

FOREIGN PATENTS OR APPLICATIONS

| | | | |
|---|---|---|---|
| 6,413,948 | 6/1966 | Netherlands | 52/20 |
| 50,831 | 5/1932 | Norway | 49/463 |
| 19,077 | 5/1906 | United Kingdom | 49/463 |
| 217,789 | 6/1924 | United Kingdom | 404/25 |
| 203,369 | 9/1923 | United Kingdom | 404/25 |
| 318,012 | 9/1929 | United Kingdom | 404/26 |

*Primary Examiner*—Ernest R. Purser
*Assistant Examiner*—Leslie A. Braun
*Attorney, Agent, or Firm*—Wenderoth, Lind & Ponack

[57] ABSTRACT

A floor hatch including an outer framework adapted to be installed in a floor of a building and having an abutment face at the upper end of the inner surface of the framework and a cover assembly fitted in the outer framework, said cover assembly including an inner framework having an abutment face at the upper end of the outer surface of the inner framework for abutting against the abutment face on the outer framework and a cover member attached to the inner framework for closing the opening in the inner framework, whereby the cover assembly is fitted and supported in the outer framework.

5 Claims, 18 Drawing Figures

FLOOR HATCH

This invention relates to a floor hatch which is adapted to be installed in a floor of a building and serves as an access for inspecting wiring, piping and the like installations provided under the building-floor.

One most typical floor hatch comprises an outer framework to be secured to a building floor and defining the opening of the hatch and a cover assembly fitted in the outer framework. The cover assembly comprises an inner framework placed on a flange extending inwardly and horizontally from the outer framework at the lower end thereof and a cover member attached to the inner framework for closing the opening in the inner framework In the conventional floor hatch, it has been frequently found that external dust, water and/or other undesirable matters invade through the clearance provided between the inner and outer frameworks for opening and closing the hatch opening into the interior of the hatch, inner offensive odor escapes through the clearance to the atmosphere and the invaded dust, mud and/or sand accumulate on the mounting flange of the outer framework to the degree that the accumulated matter or matters cause the inner framework to move up relative to the outer framework or cover assembly so as to enlarge the clearance more and more. As a result of this, the cover assembly itself is caused to emerge out of the outer framework and to be supported in the outer framework under unstable conditions resulting in frequent inconvenience in the use of the hatch.

The purpose of this invention is to provide a floor hatch which can effectively prevent the invasion of external dust, mud, sand and/or water through the interface between the inner and outer frameworks.

Another object of the present invention is to provide a floor hatch which can effectively prevent the escape of internal offensive odor through the interface between the inner and outer frameworks to the atmosphere.

Another object of the present invention is to provide a safe floor hatch in which the cover can be easily opened or closed and when closed, the cover is supported in the outer framework in a desired stabilized state in close contact with the outer framework.

Another object of the present invention is to provide a floor hatch which when closed, can effectively prevent the formation of a clearance between the inner and outer frameworks and also any excessively close contact between the inner and outer frameworks at all the times regardless of wear on the abutment face at the upper end edge of the inner framework.

Another object of the present invention is to provide a floor hatch which can effectively accommodate any deformation of the outer framework due to swelling of flooring material such as mortar at the time of laying floor boards on the floor.

Another object of the present invention is to provide a floor hatch which can effectively prevent flooring material such as mortar from flowing over the upper end of the inner framework to the interface between the inner and outer frameworks at the time of covering the floor with mortar.

Another object of the present invention is to provide a floor hatch which will not be in the way of persons walking on the floor and which is less subjected to deformation under the weight of persons walking on the floor.

Another object of the present invention is to provide a floor hatch which has a sufficient strength even when the hatch is made of relatively light weight material.

Another object of the present invention is to provide a floor hatch which includes a cover assembly capable of being easily adapted to any size opening.

Another object of the present invention is to provide a floor hatch which includes inner and outer frameworks easily formable, less subject to wear and damage, highly rigid and having a long service life.

Another object of the present invention is to provide a floor hatch which enables dust, mud and/or sand accumulating on the parts of the hatch to be easily removed therefrom and includes a water-proofing and air-tight handle.

The above and other objects and attendant advantages of the present invention will be more readily apparent to those skilled in the art from the following description when read in connection with the accompanying drawings.

Figure 1:
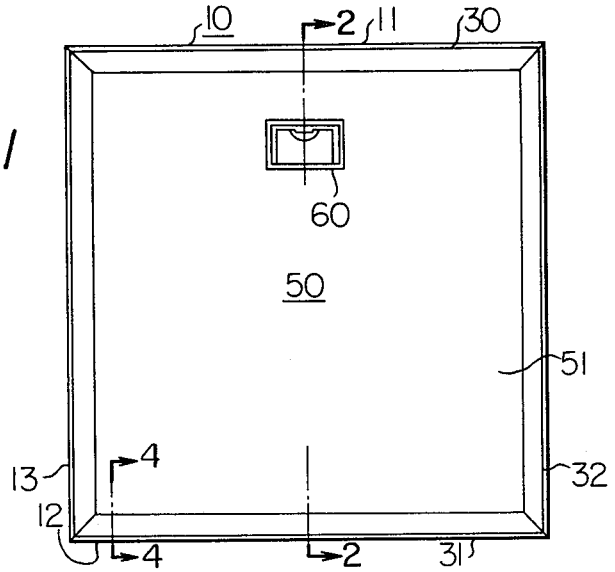
FIG. 1 is a plan view of one preferred embodiment of floor hatch of the invention having a tiling cover.
Figure 2:
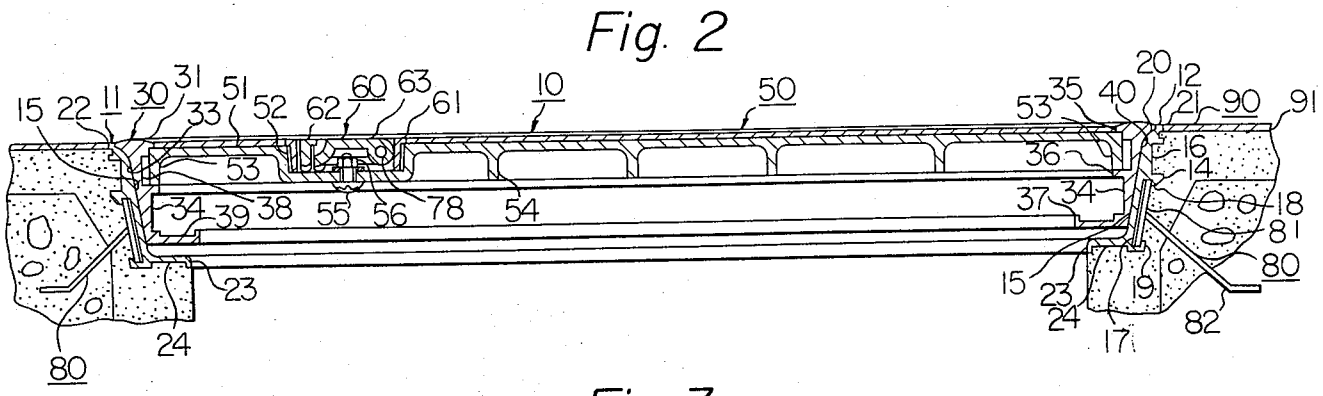
FIG. 2 is a cross-sectional view taken along the line 2—2 of FIG. 1 showing the floor hatch as installed in a building.

The present invention will be now described referring to the accompanying drawings and more particularly, to FIGS. 1 and 2 thereof which show the first embodiment of floor hatch of the invention. In these Figures, the floor hatch is generally shown by reference numeral 10 and the hatch is sown as being assembled in a square configuration structure as seen in plan. The floor hatch 10 includes a square outer framework 11 adapted to be installed in the base concrete foundation 91 of a floor 90 of a building and a tiling cover assembly 50 adapted to be fitted in the framework 11. The cover assembly 50 includes an inner framework 30 adapted to be fitted in the outer framework 11 and defining an opening therein, a cover member 51 attached to the inner framework 30 to close and open the opening and a handle 60 mounted in a recess 52 formed in the upper surface of the cover member 51.

As more clearly shown in FIGS. 1 and 2, the outer framework 11 comprises elongated outer framework elements or members 12 and 13 which may be formed by extruding or drawing aluminum and connected together with corner members (not shown) interposed therebetween.

The outer surface of each of the outer framework elements 12 and 13 has a groove 16 in the upper portion of the surface for receiving a corner member (not shown) and similarly, the lower portion of the outer surface of each outer framework element has a groove 17 defined by upper and lower anchoring flanges 18 and 19 for receiving and holding a mounting member 81 of an anchor 80 in position.

The inner surface 15 of each of the outer framework elements 12 and 13 slopes inwardly and downwardly so that when the elements are assembled together, the outer framework will have a V-shaped configuration as seen in cross-section. The inner surface 15 of each of the framework elements 12 and 13 further includes at its upper end an abutment face 20 shaped to provide a bell mouth, lapping or morning-glory cross-section and a peripheral edge 22 which provides the outer periphery 21 of the outer framework 11. The lower end of the inner surface 15 of each of the outer framework elements 12 and 13 is provided with a flange 23 extending inwardly in parallel to the building floor so that the outer framework 11 can be easily installed on the concrete foundation 91 in a stabilized condition. The undersurface of each of the flanges 23 is provided with a recess 24 for receiving another corner member (not shown) which serves to connect the adjacent outer framework elements together with the first-mentioned corner member interposed between the adjacent elements by means of suitable fastening means such as screws (not shown).

The inner framework 30 also includes elongated inner framework elements or members 31 and 32 which are formed by forming aluminum as in the case of the outer framework elements 12 and 13 and connected together with corner members (not shown) interposed therebetween by means of screws (not shown).

The outer surface 33 of the inner framework elements 31 and 32 slopes inwardly and downwardly in conformity with the sloping angle of the inner surface of the outer framework elements 12 and 13 to be closely fitted in the respectively cooperating outer framework elements 12 and 13 so that the assembled inner framework 30 will have a V-shaped cross-section similar to that of the outer framework assembly. The outer surface 33 of each of the inner framework elements 31 and 32 includes at the upper end an abutment face 40 for abutting against the opposite abutment face 20 on the cooperating outer framework element.

The lower ends of the inner framework elements 31 and 32 terminate at a position slightly above the upper surface of the lower end flanges 23 on the outer framework elements 12 and 13.

The inner surface of each of the inner framework elements 31 and 32 includes an upper end flange 35, an intermediate flange 36 and a lower end flange 37 which extend inwardly and horizontally from the inner surface of the inner framework element in parallel with each other and to the building floor surface.

When the cover assembly 50 has a tiling finish, the cover member 51 is positioned and held in position between the upper end and intermediate flanges 35 and 36. On the other hand, when the cover assembly 50 has a mortar and ceramic tiling finish, the cover member 51 is turned upside down and held in position between the intermediate and lower end flanges 36 and 37.

The inner surface 34 of each of the inner framework elements 31 and 32 has between the upper end and intermediate flanges 35 and 36 a groove 38 for receiving the first-mentioned corner member (not shown) and similarly, the upper surface of the lower end flange 37 on each of the inner framework elements 31 and 32 is provided with a groove 39 for receiving the second-mentioned corner member.

The upper surface of the cover member 51 has a recess for receiving a handle 60 a description of which will be given hereinafter and holding the handle in position by means of bolt and nut arrangement 55 and 56 and the rest of the cover member surface has tiling finish corresponding to the tiling finish of the floor surface. The undersurface of the cover member 51 has a peripheral rib 53 and a plurality of reinforcing ribs 54 integrally formed with the cover member. The cover member 51 can be conventionally formed by die-casting aluminum.

In the installation of the floor hatch 10, as sown in FIG. 2, the pre-assembled outer framework 11 is securely held in the concrete foundation 91 by embedding the leg 82 of the anchor 80 attached to the outer framework 11 and the pre-assembled inner framework 30 is placed into the thus held outer framework 11 by the use of the handle 60.

With the outer and inner frameworks 11 and 30 held in position in the manner mentioned just above, the abutment face 40 of the outer surface 33 of the inner framework 30 overlies the abutment face 20 of the inner surface 14 of the outer framework 11 in abutment to thereby support the cover assembly 50 in the outer framework 11 in suspension and also provide a long interfitting contact area between the outer and inner frameworks 11 and 30.

Figure 3:
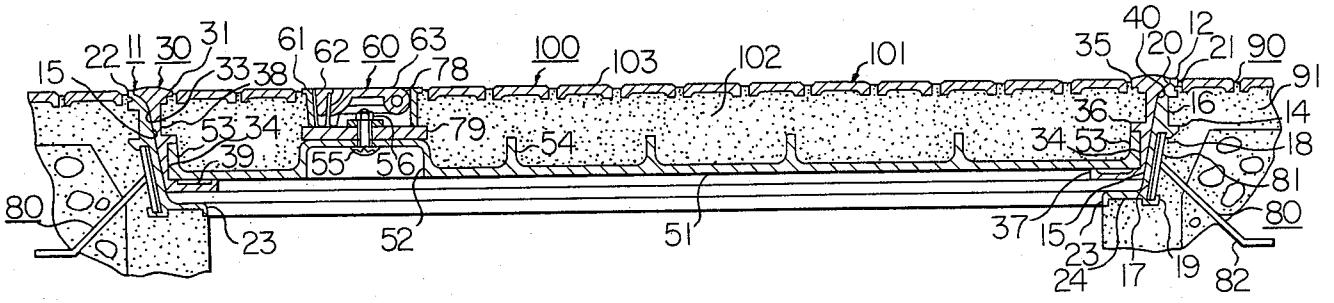
FIG. 3 is a view similar to FIG. 2, but shows a modified embodiment of floor hatch of the invention having a mortar and ceramic tiling cover as installed in a building.

The floor hatch 100 in the embodiment as shown in FIG. 3 is suitably employed in connection with a building floor 90 having a ceramic and tiling surface and includes the cover assembly 101 which has a mortar portion 102 and ceramic tiling portion 103 over the mortar portion. The parts of the floor hatch 100 of FIG. 3 corresponding to those of the floor hatch 10 of FIGS. 1 and 2 have assigned thereto the same reference numerals and a description of the corresponding parts will be omitted.

In order to provide the floor hatch 100 with the mortar and ceramic tiling portions 102 and 103, the cover member 51 is turned upside down and positioned and held between the intermediate and lower flanges 36 and 37 on the inner surface 34 of the inner framework 30.

The handle 60 is secured to the bottom of the recess 52 of the reversed cover member 51 (the recess bottom now faces upwardly) with a spacer plate 79 interposed between the cover member 51 and handle 60 by means of bolt and nut arrangement 55 and 56.

The space defined between the inner framework 30 and the reversed cover member 51 is filled with mortar 102 and a plurality of ceramic tiles 103 are placed on the top of the mortar layer 102 in a suitably spaced relationship to thereby complete the cover assembly 101.

In FIGS. 4 through 8 inclusive, various modified embodiments of floor hatch of the invention are shown and they have reference numerals 110, 150, 160, 190 and 200 assigned thereto, respectively. The modified hatches of FIGS. 4 through 8 are substantially similar to the floor hatches 10 and 100 except for the interfitting arrangement between the outer and inner frameworks, the construction of the mounting of the anchor on the outer framework and the mounting of the cover member on the inner framework and thus, a description of the corresponding parts of these modified embodiments of FIGS. 4 through 8 will be omitted.

The floor hatch 110 comprises the cover member in the form of a plate member 140 and the outer framework 111 is formed by connecting elongated rectangular aluminum outer framework elements 112 with corner members 130 interposed therebetween by means of screws 131.

The outer surface 113 of each of the framework elements 112 has a groove 115 defined by upper and lower flanges 116 and 117 for receiving and holding the associated corner member 130 in position and the inner surface 114 of each of the framework elements 112 slopes inwardly and downwardly so that when assembled, the outer framework 111 will have a V-shaped cross-section. Furthermore, the inner surface 114 of each outer framework element 112 includes an abutment face 20 of a bell mouth cross-section at the upper end and a peripheral edge 22 which provides the peripheral edge 21 for the assembled outer framework 111. The inner surface 114 of each outer framework element 112 has a flange 118 at the lower end parallel to the building floor surface.

The anchor which secures the outer framework 111 to the concrete foundation of a building has its mounting member received in the groove 115 between adjacent corner members at adjacent corners of the assembled outer framework 111.

The inner framework 120 comprises elongated rectangular inner framework elements 121 formed by forming aluminum in the same manner for forming the outer framework elements and connected together with the corner members 132 interposed therebetween by means of screws 131.

The outer surface 114 of each of the inner framework elements 121 slopes inwardly and downwardly in conformity with the sloping angle of the opposing inner surface 114 of the adjacent outer framework element 121 in close contact with the latter and the outer surface 122 has an abutment face 40 adapted to abut against the opposing abutment face 20 on the inner surface 114 on the adjacent outer framework element 112.

The lower end of each of the inner framework elements 121 terminates slightly above the lower end flange 118 on the adjacent outer framework element 112.

The inner surface 124 of each of the inner framework elements 121 extends vertically at right angles to the floor surface and has at the upper end an anchoring flange 125 for holding the plate member 140 in position.

The plate member 140 is held in position between the corner members 132 connecting the inner frame elements 121 together and anchoring flanges 125 and normally closes the opening in the inner framework 120.

The manner of mounting the floor hatch 110 is similar to that described in connection with the floor hatch 10 and a description of the mounting will be omitted.

Figure 4:
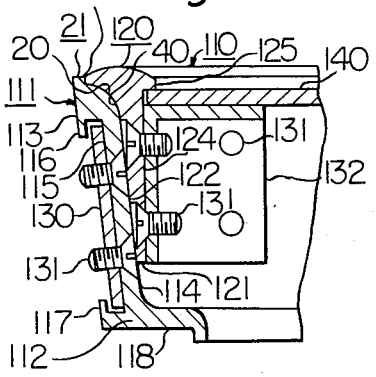
FIG. 4 is a cross-sectional view of a further modified embodiment of floor hatch of the invention taken along a line substantially corresponding to the line 4—4 of FIG. 1.
Figure 5:
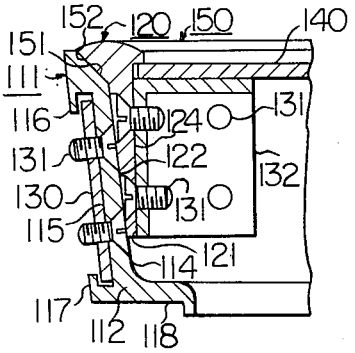
FIGS. 5, 6, 7 and 8 are views similar to FIG. 4, but show further modified embodiments of floor hatch of the invention.

The floor hatch 150 of FIG. 5 is substantially similar to the floor hatch 110 of FIG. 4 except that the abutment faces on the outer and inner frameworks 111 and 120 are somewhat modified and the remaining parts of the floor hatch of FIG. 5 are similar to the counterparts of the embodiment of FIG. 4. Thus, the corresponding parts are assigned the same reference numerals and a description thereof will be omitted.

The abutment faces 151 and 152 on the outer framework inner surface 114 and on the inner framework outer surface 122 flare at a greater angle than that at which the corresponding abutments on the outer and inner frameworks in the embodiment of FIG. 4 to thereby eliminate the peripheral edge 21 on the outer framework 111.

The floor hatch 160 is substantially similar to the floor hatch 110 of FIG. 4 except that the inner and outer surfaces 114 and 122 on the outer and inner frameworks 111 and 120 and the plate member 140 are somewhat modified. The remaining parts of the embodiment of FIG. 6 are similar to the corresponding parts of the embodiment of FIG. 4 and are designated by the same numerals and thus, and a description thereof will be omitted.

Figure 6:
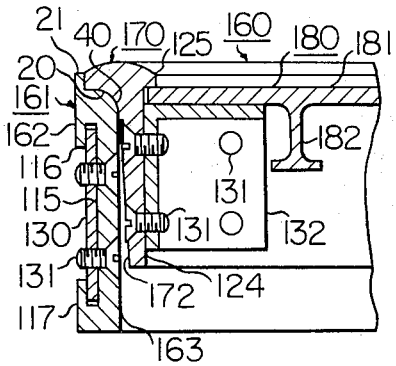

The floor hatch 160 of FIG. 6 includes the outer framework 161 consisting of outer framework elements 162 the inner surface of which is not provided with the lower end flange 118 as shown in the embodiment of FIG. 4. In addition, the portion of the outer surface 172 extending down from the abutment face 40 on the same surface tapers downwardly so as to separate from the portion of the opposing inner surface 163 extending downwardly from the abutment face 20 on the same surface whereby the inner framework will have a V-shaped cross-section and the inner framework 170 is supported within the outer framework 161 in suspension. In the embodiment of FIG. 6, the plate member 181 of the cover assembly 180 is has on the undersurface thereof a plurality of reinforcing ribs 182 (only one of the ribs is shown in FIG. 6).

Figure 7:
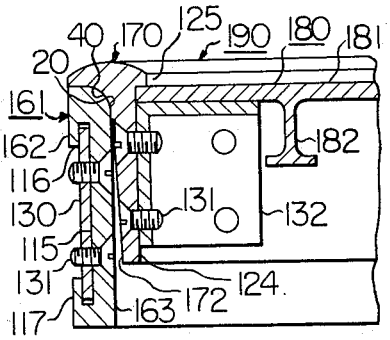

The floor hatch 190 of FIG. 7 is substantially similar to the floor hatch 160 except that the outer framework 161 is not provided at the upper end with the peripheral edge 21 as provided on the outer framework in FIG. 6 and the remaining parts of the floor hatch 190 are similar to the corresponding parts of the embodiment of FIG. 6 and the corresponding parts are shown by the same reference numerals. Thus, a description of the corresponding parts will be omitted.

Figure 8:
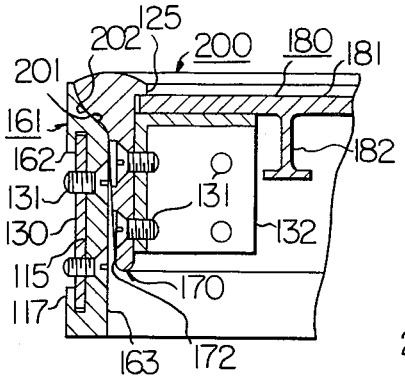

The floor hatch 200 of FIG. 8 is substantially similar to the floor hatch 160 of FIG. 6 except that the abutment faces on the outer and inner frameworks 161 and 170 are further modified and the remaining parts of the floor hatch 200 are similar to the corresponding parts of the floor hatch 160 of FIG. 6 and the corresponding parts are designated by the same reference numerals. Thus, a description of the corresponding parts will be omitted.

In the floor hatch 200 of FIG. 8, the abutment face 201 formed on the inner surface 163 of the outer framework 161 at the upper end of the surface has a concave arcuate shape and the abutment face 202 on the outer surface 172 of the inner framework 170 at the upper end of the surface has a convex arcuate shape complementary to the concave abutment face 202.

Figure 9:
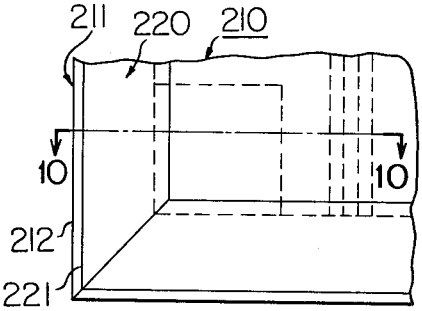
FIG. 9 is a fragmentary perspective view on an enlarged scale of one corner of a further modified embodiment of floor hatch of the invention.
Figure 10:
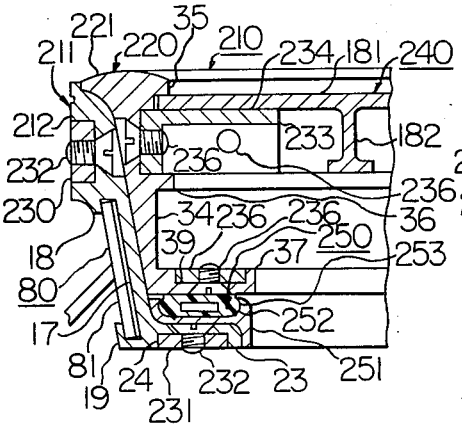
FIG. 10 is a cross-sectional view taken along the line 10—10 of FIG. 9.

The floor hatch 210 shown in FIGS. 9 and 10 is designed to improve the sealing property of the hatch and the parts corresponding to the counterparts of FIG. 6 are designated by the same reference numerals. Thus, a description of the corresponding parts will be omitted.

In the floor hatch 210 of FIGS. 9 and 10, the outer framework 211 includes elongated rectangular outer framework elements 212 connected together with corner members 230, 231 interposed therebetween by means of screws 232 and the inner framework 220 includes elongated rectangular inner framework elements 221 connected together with corner members 233 and 235 interposed therebetween by means of screws 236.

The cover member in the form of a plate member 181 is held between the flange 35 at the upper end of the inner surface 34 of the inner framework 220 and the upper support face 234 of the corner members 233 and inner framework 220 and plate member 181 cooperate with each other in forming the cover assembly 240. Furthermore, the floor hatch 210 includes a sealing means 250 disposed between the lower end flanges 23 and 27 on the outer and inner frameworks 211 and 220.

The sealing means 250 comprises a frame-like holder 251 mounted on the lower end flange 23, a square retaining groove 252 formed in the upper surface of the holder 251 and a thick walled annular tube 253 received in the groove 252. The tube 253 is formed of an elastomer material such as rubber or synthetic resin and is filled with air. The annular tube 253 may be replaced by a solid elastic filler material if desired.

Since the annular tube 253 is adapted to be deformed and pressed against the undersurface of the lower end flange 37 on the inner framework 220 by the weight of the cover assembly 240, the space between the outer and inner frameworks 211 and 220 can be maintained in an air-tight condition to thereby prevent inner offensive odor from escaping through the floor hatch 210.

Figure 11:
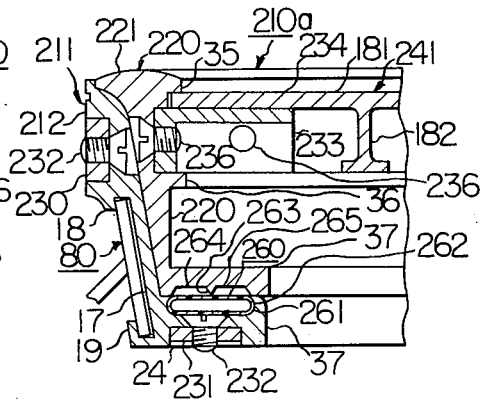
FIGS. 11 and 12 are similar to FIG. 10, but show still further modified embodiments of floor hatch of the invention.

The floor hatch 210*a* of FIG. 11 employs a modification of the sealing means 250 employed in the embodiment of FIGS. 9 and 10 and the remaining parts of the embodiment of FIG. 11 are similar to the counterparts of the embodiment of FIGS. 9 and 10. Thus, the corresponding parts are shown by the same numerals and a description of them will be omitted.

The modified sealing means 260 of the embodiment of FIG. 11 comprises a square retaining groove 261 formed in the upper surface of the lower end flange 37 on the outer framework 211, a thin-walled annular tube 262 received in the retaining groove 261, a square annular pointed projection 263 provided on the underside of the lower end flange 37 on the inner framework 220 for abutting against the tube 262 and square annular grooves 264 and 265 formed in the underside of the lower end flange 37 surrounding the projection 263. The annular tube 262 is also formed of rubber or synthetic resin and filled with air.

When the cover assembly 241 is placed in the outer framework 211, the lower end flange 37 on the inner framework 220 presses the annular tube 262 on the upper surface thereof by the weight of the cover assembly to provide a labyrinth effect between the annular tube 262 and lower end flange 37 to thereby increase air tightness between the outer framework 211 and cover assembly 241.

Figure 12:
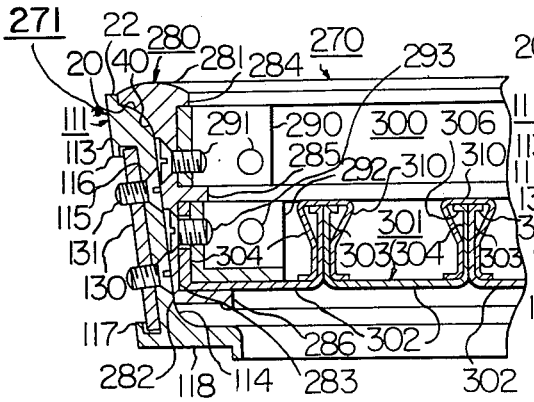
Figure 13:
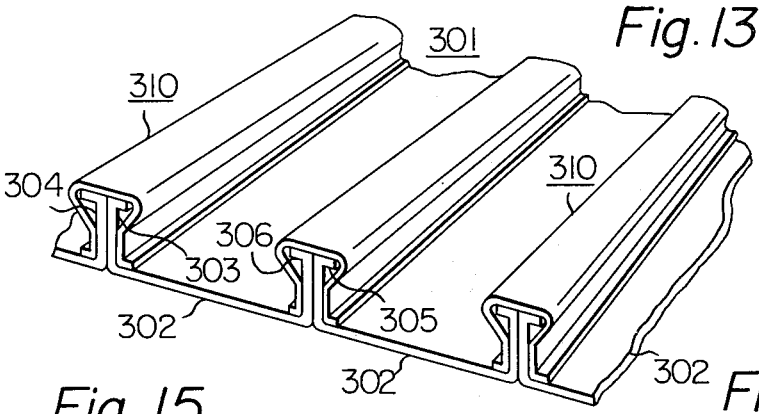
FIG. 13 is a perspective view on an enlarged scale of a portion of the cover employed in the embodiment as shown in FIG. 12.

The floor hatch 270 of FIGS. 12 and 13 employs a cover assembly comprising a cover member consisting of a plurality of cover elements the number of which varies depending upon the size of the opening. In these Figures, mortar and ceramic tiles are not shown. The outer framework 271 employed in the embodiment of FIGS. 12 and 13 is identical with the counterpart of the floor hatch 110 of FIG. 4 in construction.

Although the outer surface 282 of the inner framework 280 and the abutment face 40 at the upper end of the inner framework outer surface are the same as the counterparts of the floor hatch 110 of FIG. 4, the inner surface 283 of the inner framework 280 is modified.

The inner framework 280 comprises inner framework elements 281 and the inner surface 283 of each of the elements 281 is provided with an upper end flange 284 positioned above the cover assembly 300, an intermediate flange 285 below the cover assembly and a lower end flange 286 below the intermediate flange. These flanges extend inwardly and horizontally from the associated framework element 281 in parallel spaced relationship to each other. A corner member 290 is secured to the inner surface 283 of each of the inner framework element 281 between the upper end flange 284 and the intermediate flange 285. In this way, the plurality of inner framework elements 281 is assembled into the inner framework 280 corresponding to one corner of the element.

Similarly, a corner member 292 is secured to the inner framework 280 between the intermediate and lower end flanges 285 and 286 of the inner framework element 281 which correspond to one corner of the framework by means of a screw 293 for holding the cover assembly 301 in position. The cover assembly 301 comprises a plurality of cover elements 310 connected together by means of connectors 302.

The cover element 302 is formed by pressing or extruding steel or stainless steel into a U-shaped cross-section having upright ribs 303 and 304 at the opposite ends. In assembling the cover elements 303 into the cover assembly 301, the rib 303 at one end of the element is abutted against the rib 304 at one end of the adjacent element and the ribs 303 and 304 are then secured together by the connector 310. The ribs 303 and 304 have flanges 305 and 306, respectively, which extend at right angles to the associated upright ribs.

The connectors 310 are adapted to embrace the ribs 303 and 304 of the adjacent cover elements 302 to secure the elements together. For this purpose, the connectors 310 are made of resilient material.

In FIG. 12, the flange 305 on the rib 303 of the cover element 302 secured to the inner surface 283 of the inner framework (that is, the extreme left-hand end cover lement) is eliminated, but if desired, such a flange 305 may be, of course, employed.

Thus, the cover assembly 301 can be readily provided by selecting a desired number of cover elements 302 to meet the conditions at a building site where the floor hatch is to be installed and then connecting the elements together by the connectors 310 and this is advantageous in providing a floor hatch other than standard floor hatches.

When the cover assembly 300 of FIGS. 12 and 13 is filled with mortar for completing the assembly, mortar can be placed into the spaces defined by the adjacent cover elements of the cover member while the elements are positioned and held between the intermediate and lower end flanges 285 and 286, but when the cover assembly is completed by the employment of tiles, the cover member 301 is turned upside down and held between the upper end and intermediate flanges 284 and 285.

Figure 14:
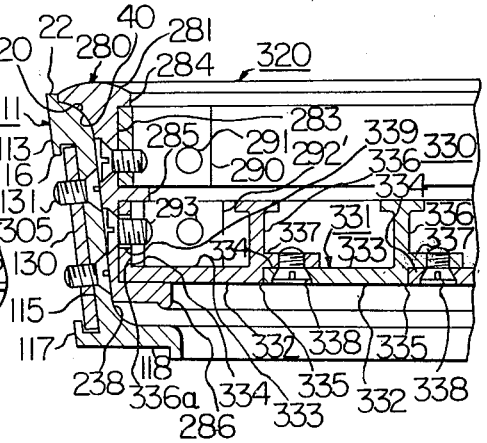
FIG. 14 is similar to FIGS. 10, 11 and 12, but shows a still further modified embodiment of the floor hatch of the invention.

The floor hatch 320 of FIG. 14 is substantially similar to the floor hatch 270 of FIGS. 12 and 13 except that the cover member 301 shown in FIGS. 12 and 13 is somewhat modified. The remaining parts of the floor hatch 320 correspond to the counterparts of the floor hatch 270 and the corresponding parts are designated by the same reference numerals. Thus, a description of the corresponding parts will be omitted.

The cover assembly 330 of FIG. 14 comprises a cover member 331 which includes a plurality of cover elements 332 connected together by means of screws 338.

Each of the cover elements 332 includes a flat horizontal plate portion 333 provided with connecting side edges 334 and 335 on the opposite sides and a T-shaped cross-section rib 336 uprightly projecting from the upper surface of the plate portion 333 at the connection edge 335. The rib 336 has a horizontally extending flange 337 to be connected to the connecting side edge 334 on the plate portion 333 of the adjacent cover element 332 by means of a screw 338.

The connecting side edge 334 on the plate portion 333 of the extreme left-hand end cover element 332 (as seen in FIG. 14) which is connected to the inner surface 283 of the adjacent inner framework element 281 has an integral upright rib 336*a* projecting therefrom.

As in the case of the cover member 301 in the floor hatch 270 of FIGS. 12 and 13, if it is desired to have the cover tiled, the cover assembly 330 can be easily completed by turning the cover member 331 upside down and holding the member between the upper and intermediate flanges 284 and 285 and then placing tiles on the now top of the cover member 331.

Figure 15:
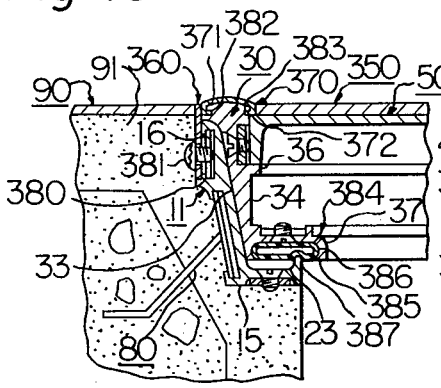
FIGS. 15 and 16 are similar to FIG. 2, but show still further modified embodiment of floor hatch of the invention.

The floor hatch 350 of FIG. 15 has improved wear resistance, rigidity and durability over the foregoing embodiments and the parts corresponding to those of the foregoing embodiments are designated by the same reference numerals. Thus, a description of the corresponding parts will be omitted.

In FIG. 15, the cover assembly 50 of the floor hatch 350 is shown as being completed with tiles and the outer framework 11 to be installed in the concrete foundation 91 underneath the building floor 90 is provided with a peripheral shielding member 360 projecting upwardly from the upper end of the framework at the outer periphery of the outer framework 11 to the plane of the floor 90. The shielding member 360 is secured to a corner member 380 held in the groove 16 and accordingly, to the outer framework 11. The top surface of the inner framework 30 which is exposed to the floor surface is covered by a top shielding member 370.

In order to prevent the top shielding member 370 from separating, the opposite side edges 371 and 372 of the top shielding member 370 in the longitudinal direction thereof are inserted in slits 382 and 383 in the upper end portions of the outer and inner surfaces 33 and 34 of the inner framework 30, respectively. The shielding members 360 and 370 are formed of a wear resisting material such as stainless steel.

Furthermore, the undersurface of the lower end flange 37 on the inner surface 34 of the inner framework 30 is provided with an annular groove 385 in which an air filled thin-walled annular tube 386 is received and the tube may be made of rubber, synthetic resin or the like material. On the other hand, the lower end flange 23 on the inner surface 15 of the outer framework 11 is provided with a projecting annular flange 387 to abut against the tube 386 to deform the tube.

Thus, the shielding members 360 and 370 are reinforced by the outer and inner frameworks 11 and 30 and the upper end face of the inner framework 30 has imparted thereto wear resisting property.

The sealing means 384 comprising the annular groove 385, annular tube 386 and annular groove 387 maintains a satisfactory air-tight condition between the outer and inner frameworks.

Figure 16:
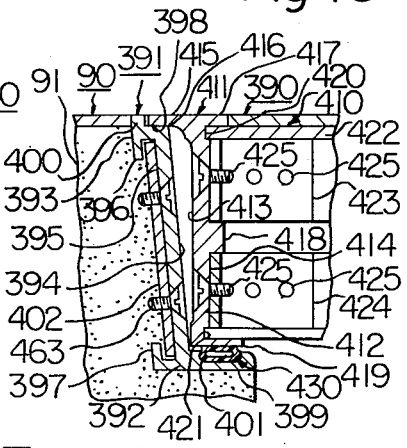

The floor hatch 390 of FIG. 16 employs the inner surface of and abutment face a the inner framework and the abutment face of the outer framework which are modifications of the corresponding parts of the foregoing embodiments.

The outer framework 391 to be installed in the concrete foundation 91 underneath the tiling floor 90 comprises elongated rectangular outer framework elements 392 connected together with corner members 402 interposed therebetween by means of screws 403 to provide a square framework.

The outer surface 393 of each of the outer framework elements 392 is provided with a groove 395 defined by upper and lower flanges 396 and 397 for receiving and holding a corner member 402 and an anchor (not shown) and the inner surface of each of the outer framework elements 392 slopes inwardly and downwardly to impart a V-shaped cross-section configuration to the framework 391. The upper end of the inner surface 394 is provided with a horizontal abutment face 398 and the lower end of the inner surface is provided with an integral flange 399 extending horizontally and inwardly from the associated surface 394. A peripheral edge 400 projects upwardly from the framework element 392 and surrounds the abutment face 398 to provide the outer periphery of the outer framework 391 and the upper surface of the lower end flange 399 is provided wih a grooved portion 401 which, when the elements 392 are assembled to the outer framework 391, forms a square groove for receiving a resilient annular tube 430 filled with air.

The cover assembly 410 to be fitted in the outer framework 391 comprises an inner frame member 411 including elongated rectangular inner framework elements 412 connected together with corner members 423 and 424 interposed therebetween by means of screws 425 to provide a square framework.

The outer surface 413 of each of the inner framework elements 412 is at right angles to the plane of the floor surface and provided at the upper end with a suspension flange 415 having an abutment face 416 adapted to lie on the abutment face 398 on the outer framework 391 in tightly engaging relationship.

The inner surface 414 of each of the inner framework elements 412 is provided with an upper end flange 417 an intermediate flange 418 and a lower end flange 419 spaced from each other in the vertical direction of the associated element.

The inner surface 414 is provided with grooves 420 and 421 adjacent to the upper end flange 417 and lower end flange 419, respectively, for alternately receiving a plate member 422.

Thus, when the cover assembly 410 is desired to be completed with tiling, the plate member 422 is fitted in the groove 420 and secured to the upper end flange 417 and the inner framework 411 by corner members 423 screwed to the inner surface 414. And when the cover assembly 410 is desired to be completed with mortar and ceramic tiling, the plate member 422 is fitted in the lower groove 421 and secured to the inner framework 411 by the lower end flange 419 and corner members 424 screwed to the inner surface 414.

In the floor hatch 390 of FIG. 16, since the annular tube 430 received in the annular groove in the lower end flange 399 of the outer framework 391 is sealingly pressed against the lower end flange 419 of the inner framework 411, inner offensive odor is effectively prevented from leaking through the interface between the outer and inner frameworks 391 and 411.

Figure 17:
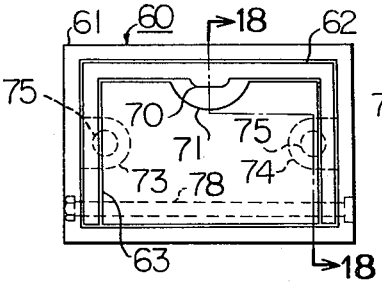
FIG. 17 is a plan view of the handle employed in the embodiment of FIG. 1.
Figure 18:
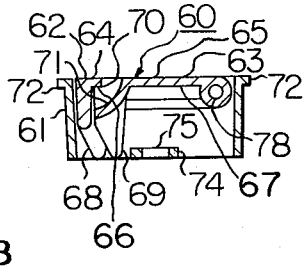
FIG. 18 is a cross-sectional view taken along the line 18—18 of FIG. 17.

FIGS. 17 and 18 show the details of the handle 60 employed in the floor hatches 10 and 100 and the handle includes a box-shaped handle storage 61, an outer handle member 62 received in the storage and an inner handle member 63 received in the outer handle member 62.

The outer and inner handle members 62 and 63 are rotatably mounted on a common shaft 78 extending through and fixedly secured to the handle storage 61 in such a manner that when the handle members are in their retracted position within the storage 61, one side 64 and 65 of the handle members lie in the plane of the top surface of the storage.

The other sides 66 and 67 of the outer and inner handle members 62 and 63 have protruding lifting portions 68 and 69, respectively and when retracted in the storage 61, the one side 64 and 65 of the handle members 62 and 63 lies in the same plane as that of the top surface of the storage.

In order that the outer handle 62 can be easily gripped for operation, the outer handle member 62 is provided with a pawl 70 and the inner handle member 63 is provided with a recess 71 in opposition to the pawl 70 for ready access to the handle. The handle storage 61 is further integrally provided on the top with a peripheral flange 72 surrounding the storage top and on the bottom with mounting flanges 73 and 74 extending inwardly toward each other. The mounting flanges 73 and 74 have holes 75 for receiving bolts 55 which attach the handle storage 61 to the cover assembly 51.

Thus, when the handle members are retracted in the storage 61, the handle 60 will not be in the way of persons who walk on the floor and assures a perfect sealing for the floor hatch. And even when dust, dirt, sand and the like have invaded the handle, they can be easily removed.

While various embodiments of the invention have been shown and described in detail, it will be understood that they are for the purpose of illustration only and are not to be taken as a definition of the scope of the invention, reference being had for this purpose to the apprended

What is claimed is:

1. A floor hatch comprising:

a quadrilateral outer framework adapted to be installed in a building floor and having an abutment face at the upper end of the inner surface of said outer framework; and a cover assembly fitted in said outer framework, said cover assembly including:

a quadrilateral inner framework for supporting said cover assembly in said outer framework and having an abutment face on the outer surface of said inner framework for sealingly engaging against said abutment face of said outer framework;

said inner framework having four elongated inner framework members and corner members connecting said framework members together and screws joining said framework members and said corner members;

an upper end flange around the inside of said inner framework adjacent the upper edge of said inner framework;

an intermediate flange around the inside of said inner framework intermediate the upper and lower edges of said inner framework;

a lower end flange around the inside of said inner framework adjacent the lower edge of said inner framework;

said flanges extending horizontally inwardly from said inner framework and a cover member engaged between a pair of adjacent flanges and fixed in said inner framework between said adjacent flanges for closing the opening in the inner framework;

each of said flanges being spaced from an adjacent flange a distance substantially equal to the thickness of the edge of said cover member, whereby the cover member is held in the inner framework between a pair of adjacent flanges without the necessity of any fastening means and when the cover member is between the upper and intermediate flanges, the upper surface of the cover member is substantially flush with the floor around the outer framework so that a floor covering can be placed on the floor hatch, and when the cover member is between the intermediate and lower flanges there is a space between the cover member and the top edges of the inner and outer frameworks which can be filled with concrete or the like for providing a surface level with the floor surface around the floor hatch.

2. A floor hatch as claimed in claim 1 in which said cover member is held in said inner framework between said intermediate and said upper end flanges.

3. A floor hatch as claimed in claim 1 in which said cover member is held in said inner framework between said intermediate and lower end flanges.

4. The floor hatch according to claim 1, in which said cover member comprises a plurality of cover elements and connectors connecting said cover element in succession.

5. The floor hatch according to claim 1, further comprising sealing means between the lower ends of said outer and inner frameworks.

* * * * *